US008807176B2

(12) United States Patent
Hilliard, Jr. et al.

(10) Patent No.: US 8,807,176 B2
(45) Date of Patent: Aug. 19, 2014

(54) APPARATUS AND METHOD FOR FILLING A CONTAINER WITH AT LEAST TWO COMPONENTS OF A COMPOSITION

(75) Inventors: Peter R. Hilliard, Jr., Far Hills, NJ (US); Mahmoud Hassan, Somerset, NJ (US); John H. Swanson, Rutherford, NJ (US)

(73) Assignee: Colgate-Palmolive Company, New York, NY (US)

( * ) Notice: Subject to any disclaimer, the term of this patent is extended or adjusted under 35 U.S.C. 154(b) by 444 days.

(21) Appl. No.: 13/202,508

(22) PCT Filed: Mar. 6, 2009

(86) PCT No.: PCT/US2009/036374

§ 371 (c)(1),
(2), (4) Date: Aug. 19, 2011

(87) PCT Pub. No.: WO2010/101576

PCT Pub. Date: Sep. 10, 2010

(65) Prior Publication Data

US 2011/0297274 A1 Dec. 8, 2011

(51) Int. Cl.
*B65B 1/04* (2006.01)
*B01F 13/10* (2006.01)

(52) U.S. Cl.
CPC ..... *B01F 13/1055* (2013.01)
USPC ..... 141/9; 141/105

(58) Field of Classification Search
USPC ..... 141/9, 105
See application file for complete search history.

(56) References Cited

U.S. PATENT DOCUMENTS

| | | | | |
|---|---|---|---|---|
| 3,509,920 | A | 5/1970 | Word | |
| 3,941,357 | A | 3/1976 | Wurtz | |
| 4,159,028 | A * | 6/1979 | Barker et al. | 141/9 |
| 4,408,893 | A * | 10/1983 | Rice, III | 366/339 |
| 4,966,205 | A * | 10/1990 | Tanaka | 141/9 |
| 6,849,584 | B2 | 2/2005 | Geary et al. | |
| 2003/0003069 | A1 | 1/2003 | Carson et al. | |
| 2003/0152540 | A1 | 8/2003 | Putman et al. | |
| 2004/0021119 | A1 | 2/2004 | Hattori | |
| 2004/0024874 | A1 | 2/2004 | Smith | |
| 2004/0057920 | A1 | 3/2004 | Focht et al. | |
| 2004/0092415 | A1 | 5/2004 | Focht et al. | |
| 2004/0219119 | A1 | 11/2004 | Wei et al. | |
| 2004/0220063 | A1 | 11/2004 | Chappell et al. | |
| 2004/0223929 | A1 | 11/2004 | Clapp et al. | |

(Continued)

FOREIGN PATENT DOCUMENTS

| | | |
|---|---|---|
| EP | 1 426 099 | 6/2004 |
| WO | WO 00/13518 | 3/2000 |

OTHER PUBLICATIONS

International Search Report and the Written Opinion issued in PCT/US2009/036374 mailed Dec. 4, 2009.

*Primary Examiner* — Timothy L Maust
(74) *Attorney, Agent, or Firm* — Judy W. Chung

(57) ABSTRACT

A method for forming a diffuse visual pattern of two or more product components in a container. The method includes providing a filler/mixer having a mixing chamber with up to about 10 mixing elements. A container is positioned after the mixing chamber on a container support that is capable of rotating the container. The components are fed into the mixing chamber to form a mixture. The mixture is fed into the container while it is rotated and concurrently separated from the mixing chamber.

18 Claims, 11 Drawing Sheets

(56) References Cited

U.S. PATENT DOCUMENTS

| | | | |
|---|---|---|---|
| 2004/0223991 | A1 | 11/2004 | Wei et al. |
| 2004/0235693 | A1 | 11/2004 | Wei et al. |
| 2005/0143268 | A1 | 6/2005 | Midha et al. |
| 2005/0143269 | A1 | 6/2005 | Wei et al. |
| 2005/0153852 | A1 | 7/2005 | Evans et al. |
| 2005/0192187 | A1 | 9/2005 | Wagner et al. |
| 2005/0233935 | A1 | 10/2005 | Gunn et al. |
| 2005/0238680 | A1 | 10/2005 | Stella et al. |
| 2005/0239670 | A1 | 10/2005 | Stella et al. |
| 2005/0276768 | A1 | 12/2005 | Wei et al. |
| 2005/0276829 | A1 | 12/2005 | Stella et al. |
| 2006/0008438 | A1 | 1/2006 | Velarde et al. |
| 2006/0078524 | A1 | 4/2006 | Midha et al. |
| 2006/0078527 | A1 | 4/2006 | Midha et al. |
| 2006/0079417 | A1 | 4/2006 | Wagner et al. |
| 2006/0079418 | A1 | 4/2006 | Wagner et al. |
| 2006/0079419 | A1 | 4/2006 | Wagner et al. |
| 2006/0079420 | A1 | 4/2006 | Wagner et al. |
| 2006/0079421 | A1 | 4/2006 | Wagner et al. |
| 2006/0079422 | A1 | 4/2006 | Midha et al. |
| 2006/0191589 | A1 | 8/2006 | McCall et al. |
| 2006/0210505 | A1 | 9/2006 | Clapp et al. |
| 2006/0234886 | A1 | 10/2006 | Massaro et al. |
| 2006/0239945 | A1 | 10/2006 | Bapat et al. |
| 2006/0239953 | A1 | 10/2006 | Clapp et al. |
| 2006/0251606 | A1 | 11/2006 | Coffindaffer et al. |
| 2006/0270584 | A1 | 11/2006 | Frantz et al. |
| 2006/0276357 | A1 | 12/2006 | Smith et al. |
| 2007/0009463 | A1 | 1/2007 | Niebauer et al. |
| 2007/0009472 | A1 | 1/2007 | Niebauer et al. |
| 2007/0010410 | A1 | 1/2007 | Niebauer et al. |
| 2007/0014823 | A1 | 1/2007 | Iwata |
| 2007/0044824 | A1 | 3/2007 | Capeci et al. |
| 2007/0047383 | A1 | 3/2007 | Williams et al. |
| 2007/0047384 | A1 | 3/2007 | McLaughlin et al. |
| 2007/0071780 | A1 | 3/2007 | Dubois et al. |
| 2007/0102058 | A1 | 5/2007 | Houzego |
| 2007/0117729 | A1 | 5/2007 | Taylor et al. |
| 2007/0141001 | A1 | 6/2007 | Clapp et al. |
| 2007/0155637 | A1 | 7/2007 | Smith et al. |
| 2007/0248562 | A1 | 10/2007 | Berry et al. |
| 2007/0280976 | A1 | 12/2007 | Taylor et al. |
| 2007/0286832 | A1 | 12/2007 | Clapp et al. |
| 2008/0051314 | A1 | 2/2008 | Wenzel et al. |
| 2008/0196787 | A1 | 8/2008 | Comstock et al. |

* cited by examiner

APPARATUS AND METHOD FOR FILLING A CONTAINER WITH AT LEAST TWO COMPONENTS OF A COMPOSITION

CROSS-REFERENCE TO RELATED APPLICATIONS

This application is a national stage entry under 35 U.S.C. §371 of International Patent Application No. PCT/US2009/036374, filed Mar. 6, 2009, the contents of which are incorporated herein by reference.

BACKGROUND OF THE INVENTION

There are various techniques to provide a unique appearance to a packaged product. Many techniques are directed to the use of colored containers and attractive labeling. Another technique is to use the product to additionally provide part of the overall unique appearance of the product. U.S. Pat. No. 4,159,028 to Barker et al. discloses a technique for forming a two part cosmetic composition into a random pattern of the composition in a container. This comprises rotating the container at an angle to the filling conduit and filling the rotating and angled container simultaneously with the two parts of the composition. The result will be a random pattern of the two components in the container. In U.S. Pat. No. 4,966,205 to Tanaka there is a modification of the above technique. Here the components are a transparent gel base and a colored material. U.S. Pat. Nos. 6,213,166; 6,367,519 and 6,516,838 to Thibiant et al. are directed to an apparatus and process to produce precise and exacting swirl patterns. The compositions can be cosmetic compositions with one component being transparent to translucent and the preferred container being transparent. The two components are filled into the container as the container is being rotated. The filler is raised out of the container as the container is being filled. U.S. Design Pat. Nos. 429,146 and 448,281 disclose some of the patterns that can be produced using the processes of these three patents. Products that can be produced in various patterns are disclosed in U.S. Patent Application Publication 2005/0143268 to Sanjeev et al. Patterns which can be made from this patent application include the patterns shown in U.S. Design Pat. No. 548,599 and U.S. Design Pat. No. 552,997. These are interesting techniques to produce various designs of products in containers. While the technique of U.S. Pat. No. 4,159,028 usually will produce random patterns the techniques of the latter patents are directed to forming more geometrically defined patterns.

BRIEF SUMMARY OF THE INVENTION

The invention is directed to a method of forming in a container a diffuse pattern mixture of at least two components, the at least two components having differing visual characteristics, comprising providing a filler/mixer having a mixing chamber, a mixing chamber input conduit into the mixing chamber for each of the at least two components, 0 to about 10 mixing elements in the mixing chamber, an exit conduit from the mixing chamber, a container after the mixing chamber on a container support, the container support being capable of rotating the container; feeding a first component and a second component into the mixing chamber to form a mixture of the first component and the second component; concurrently rotating the container in a first direction and feeding the first component and second component mixture from the mixing chamber into the container; continuing to feed the first component and second component mixture into the container and rotating the container in a second direction, then concurrently separating the container from the mixing chamber during the rotation of the container in a first direction and in a second direction. The rotation of the container in a first direction and in a second direction can optionally be repeated.

In one aspect, the present processes can produce diffuse patterns of one or more products in containers. The results are unique and very artistic patterns. One type of pattern is that of sand art type of pattern. The product in the container will give a sand art appearance to the container. By diffuse pattern is meant a pattern that has a discernable artistic pattern, but where the pattern varies in dimensions and the color varies in color density to provide a color gradation throughout the container. In one embodiment there will be bands of one product dispersed in another product, the bands varying in their dimensions and the color of the bands varying in color density.

DETAILED DESCRIPTION OF THE INVENTION

Figure 1:
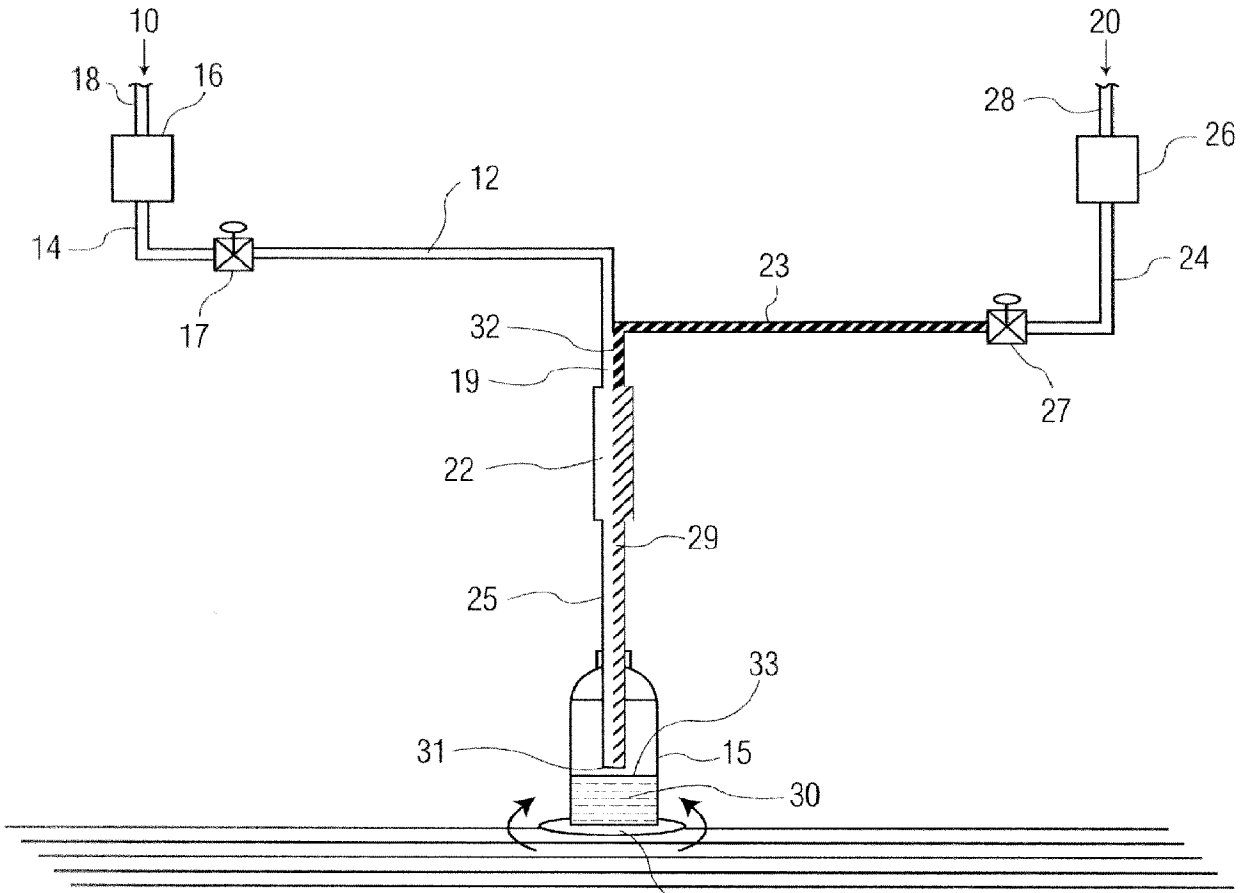
FIG. 1 is an elevation view of a layout diagram of a process of filling a container according to one embodiment of the present invention.

The invention will now be described in more detail in its preferred embodiments with reference to the drawings. The described processes may be modified in minor details without departing from the concept of the present invention. As used throughout this description, ranges are used as a shorthand for describing each and every value that is within the range. Any value within the range can be selected as the terminus of the range. Additionally, the terms in-line mixer and static mixer refer to the same type of mixer.

This invention relates to a method and apparatus for filling into a container a multi-component composition in a diffuse pattern where the components have at least one visually discernable different characteristic. More particularly the invention relates to the filling of a transparent to translucent container with such a composition that has a diffuse pattern to produce a container and product that has a unique appearance to the exterior of the container.

The present process will produce containers filled with two or more components in a diffuse pattern design. In one embodiment this has been likened to a sand art type of design resulting from the filling of containers with two or more non-Newtonian structured and viscous liquids that exhibit visually distinct attributes, one from the other. The precise patterns and the intensity of the patterns are the result of the process parameters in the filling of the containers. The process parameters include the rheology of the first and the second non-Newtonian structured liquids, the amount of each of the first component and of the second component, the input pressure of the first component and the second component, the dimensions of the mixing chamber, the flow rate through the mixing chamber, the dimensions of the mixing chamber exit conduit, the presence, number and orientation of static mixers, the shape of the container, and the degree and rate of oscillation of the container. There will be a varying degree of mixing of the first component and the second component from the input of each into the mixing chamber to the exit of the mixing chamber output conduit.

The container is rotated at least 90 degrees in the first direction and at least 90 degrees in the second direction, preferably at least about 180 degrees in the first direction and at least about 180 degrees in the second direction.

The container can be at an angle of 0 degree to about 15 degrees to an exit conduit from the mixing chamber during filling. The container support will maintain the container at the angle of 0 degree to about 15 degrees. The container also can be subject to a vibration during filling.

The mixing chamber exit conduit extends within the container at the initiation of the filling of the container and is separated from the container during the filling of the container by one of the filler exit conduit being withdrawn from the container or the container being withdrawn from the filler exit conduit. The filler exit conduit, or the container, is withdrawn at a rate of about 2 mm to about 10 mm per second.

In one embodiment, one or more mesh screens can be disposed at the outlet of the exit conduit. If using more than one mesh screen, the angle of one screen relative to another screen can be varied at an angle greater than 0 to less than 180°. The mesh can be made from any material. The material should be strong enough to minimize deformation when material flows through the mesh. The openings in the mesh can be any desired size or shape.

Mixing elements in the mixing chamber can be part of a mixing element unit, the mixing element unit can be a static mixer having from 1 to 10 mixing elements, and preferable about 2 to 7 mixing elements.

The mixing element unit has an upper first element, the upper first element having a top surface with side surfaces tapering downwardly from the top surface, the first component and the second component having a common interface, the common interface upon contact with the first upper element top surface being at an angle of 0 degrees to 90 degrees to the first upper element top surface. The common interface upon contact with the first upper element top surface preferably being at an angle of about 25 degrees to about 75 degrees to the first upper element top surface.

Either the first component or the second component is fed first into the mixing chamber at an angle of 0 degrees to about 90 degrees to the axis of the mixing chamber.

Figure 2:
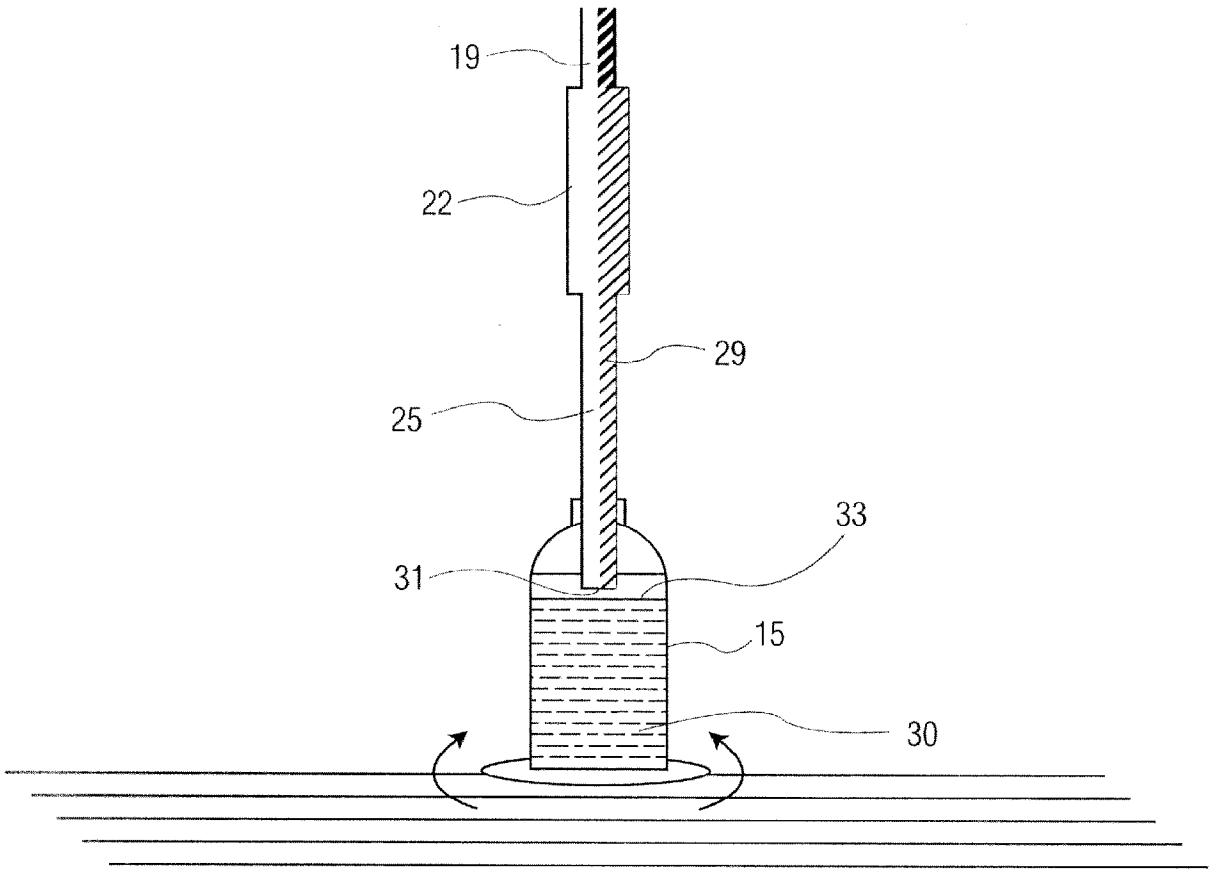
FIG. 2 is a close-up elevation view of the layout diagram of FIG. 1 shown substantially filled container.

FIG. 1 is a layout diagram of one embodiment of the filling apparatus. In FIG. 1 a container 15 is at an early stage of being filled with a product 30. There are two separate components needed to produce the product 30 in the container 15. These are a first component 10 and a second component 20. The first component 10 and the second component 20 are visually distinct from each other. The first component 10 is fed into a flow meter 16 through a flow meter input conduit 18. The first component exits the flow meter 16 through a flow meter exit conduit 14 to a valve 17. The first component 10 flows from the valve 17 through a first component input conduit 12 to a mixing chamber input conduit 19. At the same time, the second component 20 is fed into a second flow meter 26 through a second flow meter input conduit 28. The second component 20 exits the second flow meter 26 through the second flow meter exit conduit 24 to a second valve 27. The second component 20 flows from the second valve 27 through a second component input conduit 23 to the mixing chamber input conduit 19 and then into a mixing chamber 22. The first component 10 and the second component 20 combine in the mixing chamber input conduit 19 and in the mixing chamber 22. In this embodiment, the first and second component 10, 20 undergo a more limited mixing than in a second embodiment discussed in more detail below. The mixing is more limited because the non-Newtonian rheology of the components 10, 20 in this embodiment does not require the use of in-line mixers. The now at least partially mixed first component 10 and second component 20 flow as partially mixed product 29 through a mixing chamber exit conduit 25 and exit as the product 30 into the container 15. The container 15 is positioned on a rotatable support 13. The container 15 is rotated in a first direction and then in a second direction while the container 15 is being filled with the product 30. An oscillating motion is imparted to the container 15. Concurrently, the mixing chamber exit conduit 25 is raised from the container 15 as the level 33 of the product rises in the container 15. As an alternative to raising the mixing chamber exit conduit 25, the support 13 can be lowered. It is preferred that the exit opening 31 of the mixing chamber exit conduit 25 be maintained above the level 33 of the product 30 in container 15 during the filling of the container 15. FIG. 2 shows the layout diagram of FIG. 1 with the container 30 substantially filled. All parts of the filling apparatus remain the same. The difference is that the mixing chamber exit conduit 25 has been raised within the container 15 during the filling operation to maintain the end of the exit opening 31 of the mixing chamber exit conduit 25 above the level 33 of product 30 in container 15.

The container on the rotatable support 13 can be rotated in a first direction through at least 90 degrees, and then in a second direction through at least 90 degrees. In order to get the present random pattern designs the containers are first rotated in a first direction and then in a second direction in an oscillating motion. The oscillations of a rotation in a first direction and then in a second direction are limited only by the flow rate of the first component 10 and second component 20 mixture into the container 15 to fill the container 15. During this process the mixing chamber exit conduit end opening 31 of is maintained above fill level of the product 30 in the container 15. This is accomplished by either raising the mixing chamber conduit 25 upward or by lowering the container support 13. It is preferred to raise the mixing chamber exit conduit 25. The rate of rise of the mixing chamber exit, conduit 25 and the number and speed of the oscillations of the container 15 will determine the random pattern that is formed of the first component and second component mixture 30 in the container 15. The oscillations usually will be through about 120 degrees to about 480 degrees and will comprise about 1 oscillation to about 10 oscillations and preferably about 2 to 7 oscillations to fill a container 15. The mixing chamber exit conduit 25 will be separated from the container 15 at a rate of about 1.5 mm per second to about 7.5 mm per second.

Also shown in FIGS. 1 and 2 is the flow of the first component 10 and the second component 20 into the mixing chamber input conduit 19 at different points. Here the first component 10 is shown as flowing into the mixing chamber input conduit 19 above the point that the second component 20 flows into the mixing chamber input conduit 19. However, the flows of the first component 10 and the second component 20 into mixing chamber input conduit 19 may be reversed.

Figure 3:
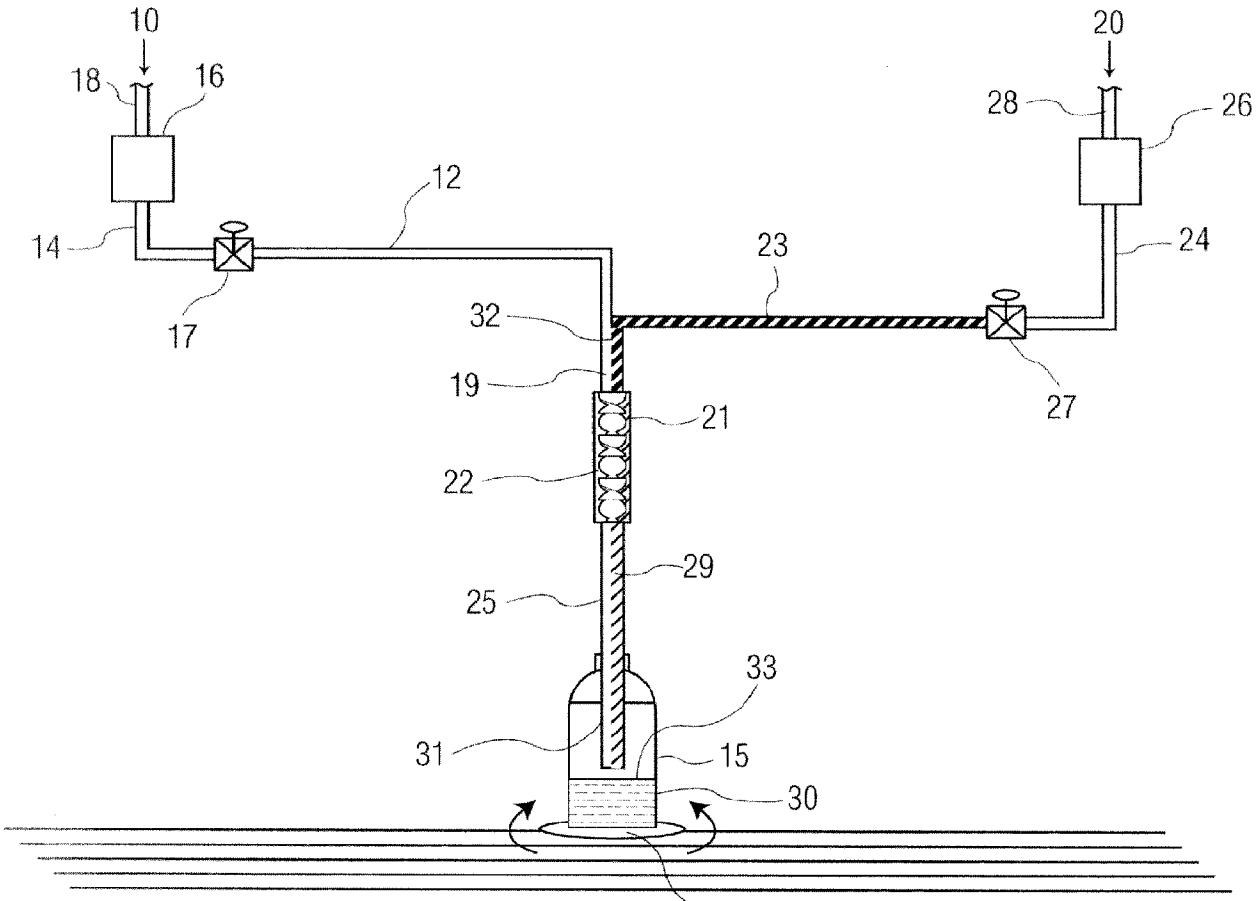
FIG. 3 is an elevation view of a layout diagram of a process of filling a container according to a second embodiment of the present invention.
Figure 4:
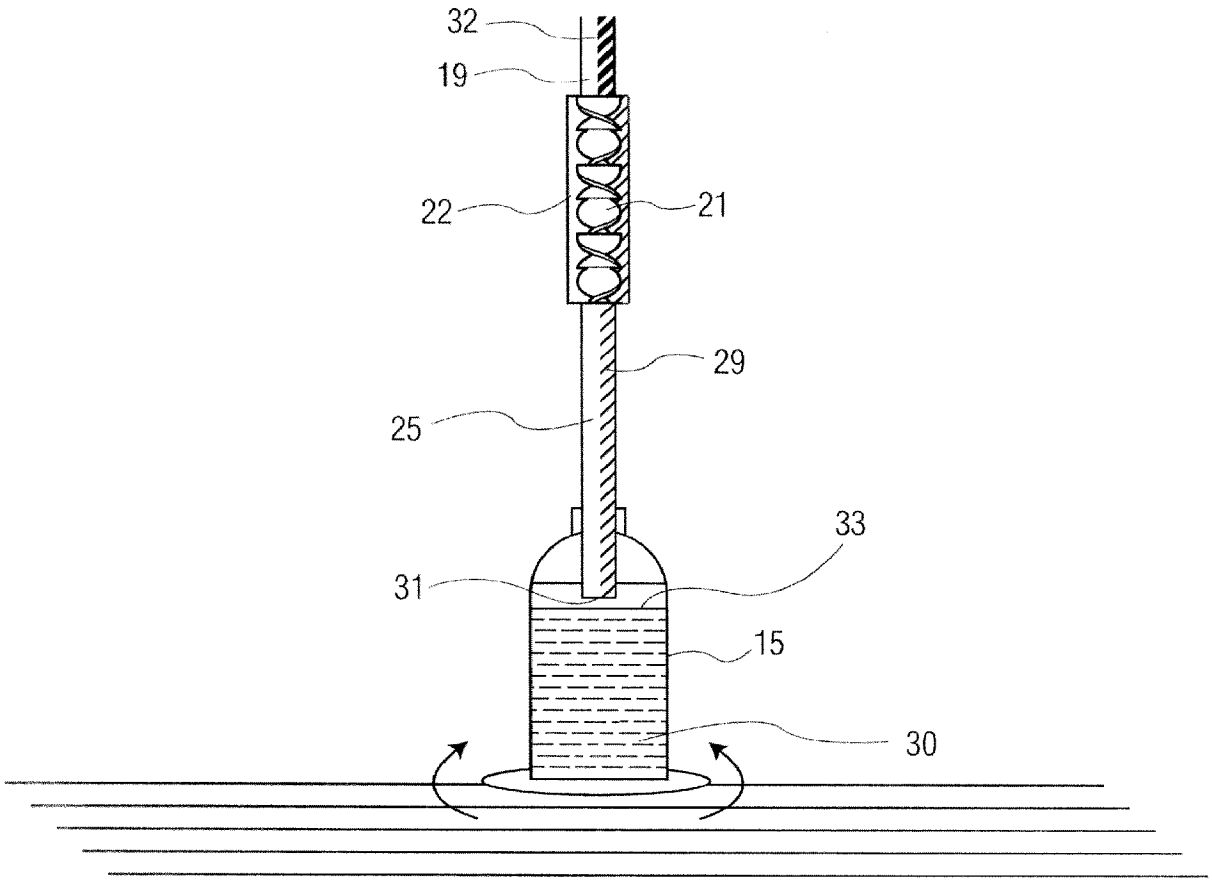
FIG. 4 is a close-up elevation view of the layout diagram of FIG. 3 showing a substantially filled container.
Figure 9:
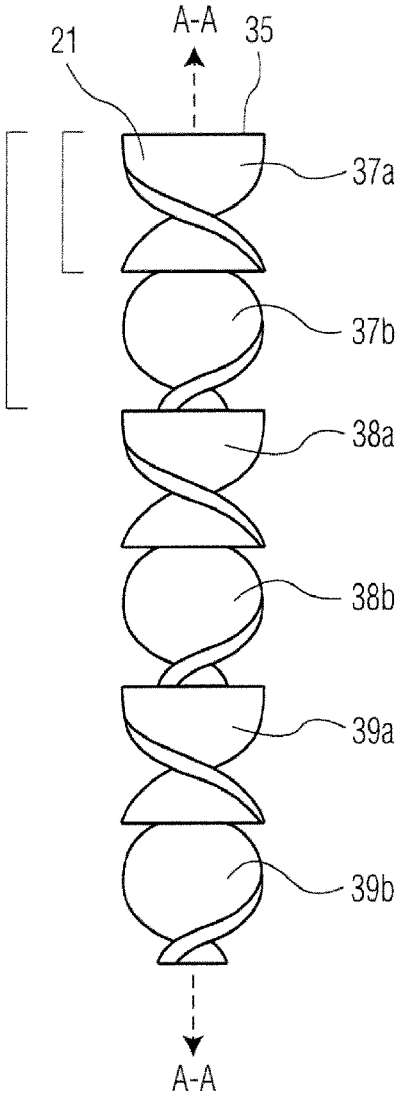
FIG. 9 is an elevation view of an inline mixing element unit within a mixing chamber.

FIG. 3 is an embodiment of the filling apparatus of FIG. 1 but with mixing element unit 21 in the mixing chamber 22. The mixing element unit 21 contains a plurality of mixing elements. The mixing element 21 may be a static mixer. The mixing element unit 21 may contain about 2 to 10 mixing elements. FIG. 9 shows a mixing element unit having six mixing elements. FIG. 4 is an embodiment of the apparatus of FIG. 3 where there is a mixing element unit 21 in the mixing chamber 22. The other elements shown in FIG. 4 are essentially the same as those of FIG. 2. To avoid redundancy, the description of the remaining elements of FIG. 4 will not be repeated.

Figure 5:
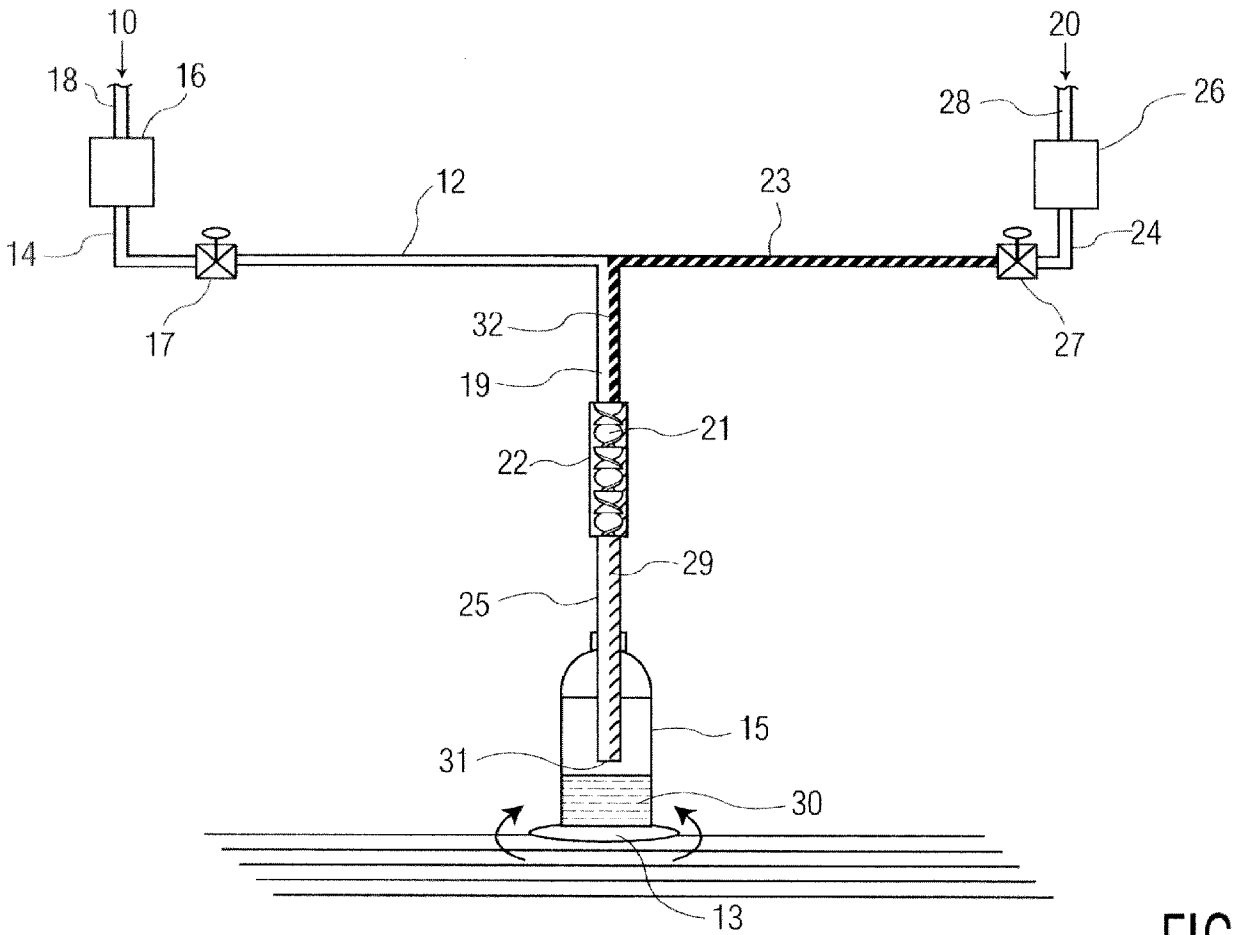
FIG. 5 is an elevation view of a layout diagram of a process of filling a container according to a third embodiment of the present invention.
Figure 6:
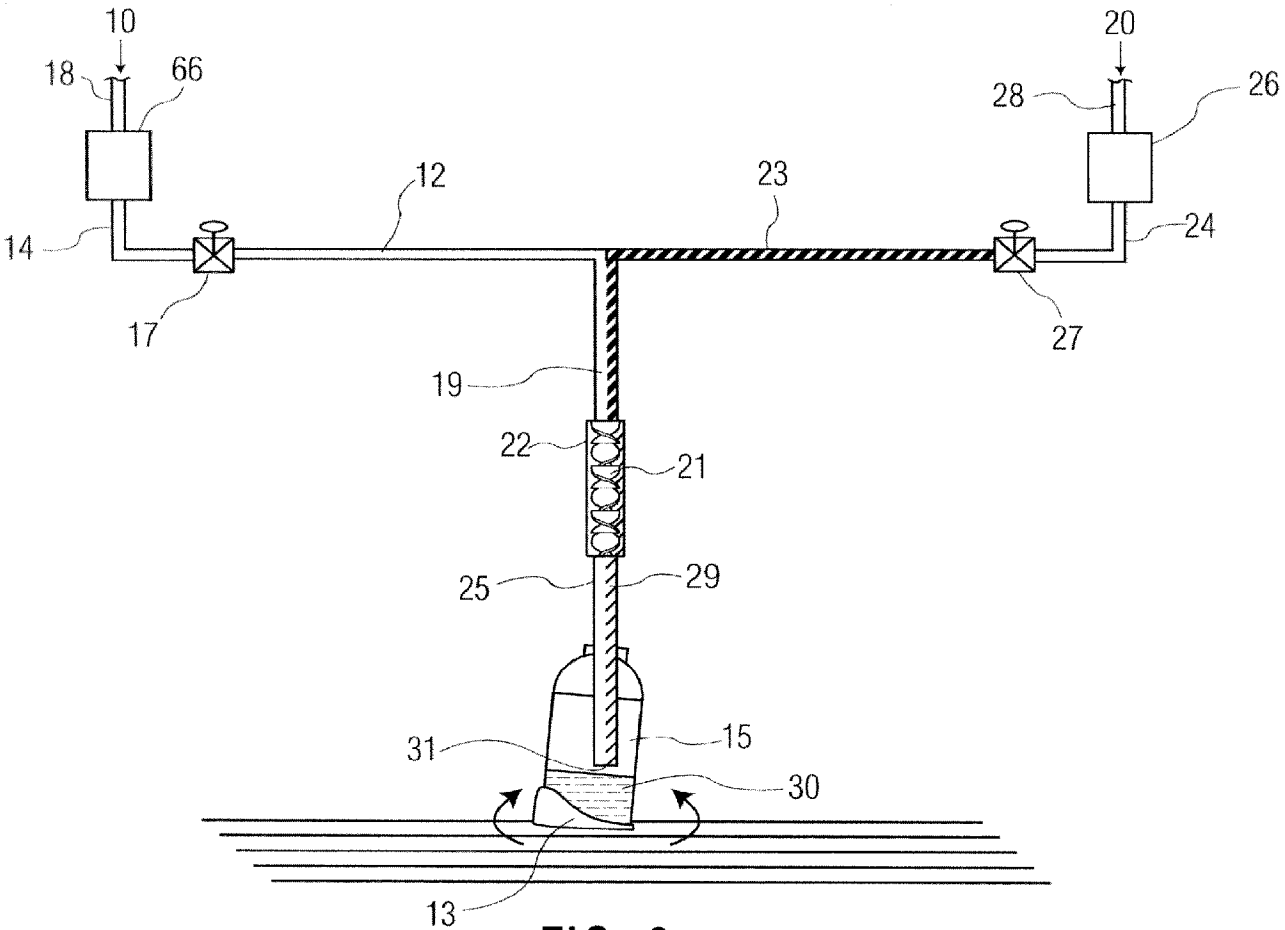
FIG. 6 is an elevation view of the layout diagram of FIG. 5 in which the support for the container is tilted at an angle to the mixing chamber conduit.

FIG. 5 shows an embodiment similar to that of FIGS. 3 and 4 except that the first component conduit 12 and the second component conduit 23 deliver the first component and the second component into the mixing chamber input conduit 19 at the same point. The two streams will simultaneously meet and flow through the mixing chamber input conduit 19 and into the mixing chamber 22. The mixing primarily will occur in the mixing chamber 22 upon contact with the mixing element unit 21. FIG. 6 shows an embodiment similar to that of FIG. 5, except that the container 15 is tilted at an angle to the mixing chamber exit conduit 29 as it is being rotated and filled. The angling may be at an angle of about 3 degrees to about 20 to the exit 31 of the mixing chamber exit conduit 25. This tilting of the container 15 during filling also can be utilized in the embodiments of FIGS. 1 and 2.

Figure 7:
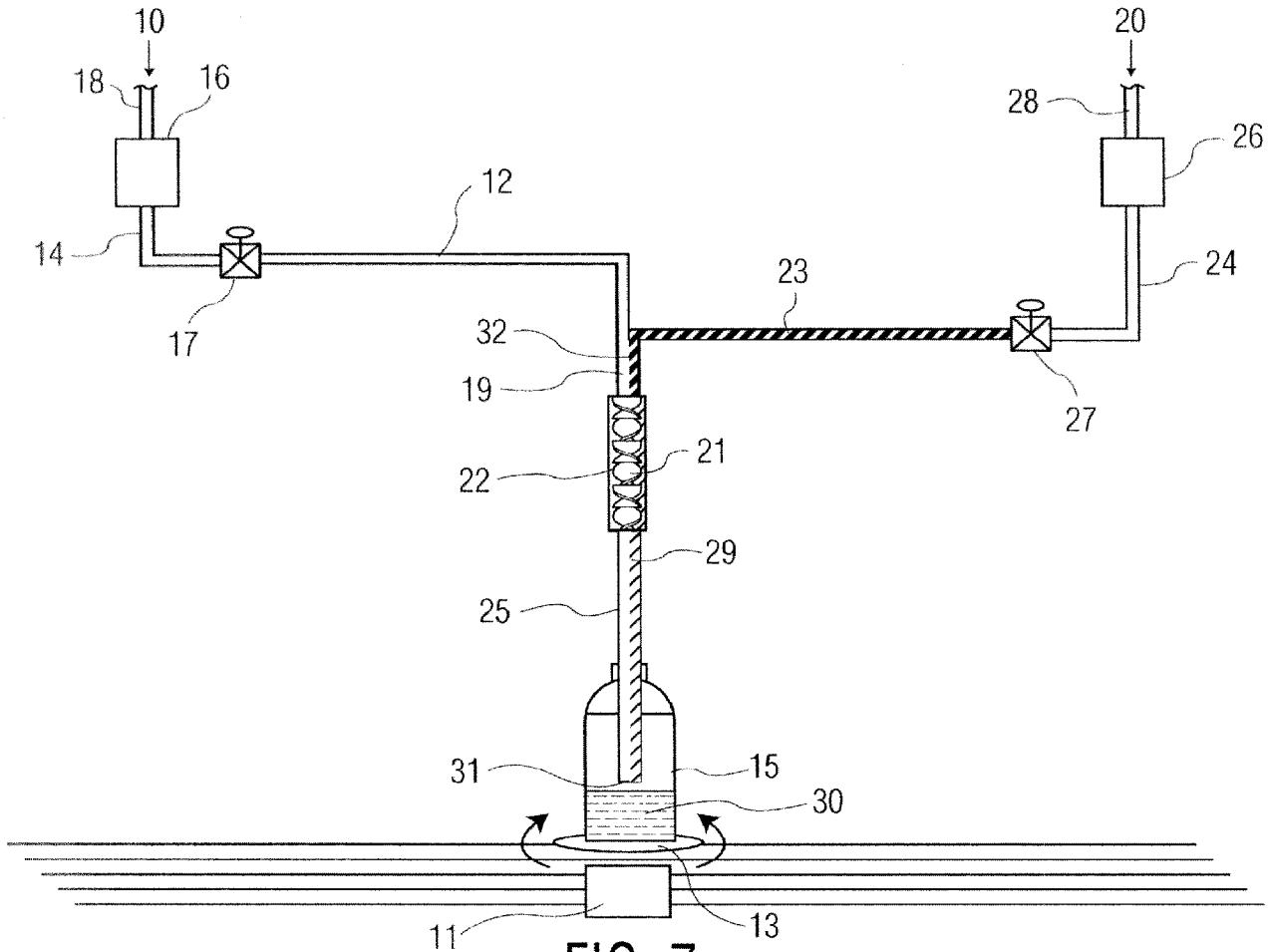
FIG. 7 is an elevation view of the layout diagram of FIG. 1 in which the support for the container is subject to vibration.

FIG. 7 discloses an embodiment similar to that of FIGS. 3 and 4. In FIG. 7, the support 11 includes a device to vibrate the base 13 and thereby vibrate the container 15. The vibration may occur while the base 13 is being rotated. The result is that the container 15 is being vibrated while the container 15 is being oscillated and filled with the first component and the second component to produce random pattern mixture 30. This also is applicable to the embodiment of FIGS. 1 and 2. Of course, the vibration and oscillation do not have to occur at the same time. Additionally, it is not required that the container 15 be oscillated in this embodiment of the invention.

The vibration of the base 13 and the container 15 during the filling of the container will cause the pattern of the product 30 in the container 15 to become more diffuse and will promote product 30 as it exits mixing chamber exit conduit 25 to flow away from mixing chamber exit conduit 25 to parts of the container that are more distant from the mixing chamber exit conduit 25. This will be useful in filling non-circular containers such as oval containers that have an elliptical cross-section. It also will be useful in the filling of non-axial containers. These are containers that are not symmetrical around the axis of the container formed through the container fill and dispensing opening. Both the amplitude and the frequency of the vibrations will depend on the particular formulations.

Figure 8A:
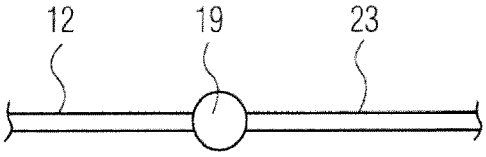
FIG. 8A is a top plan view of the first component input conduit and the second component input conduit entering the mixing chamber input conduit at opposed 180 degree points.
Figure 8B:
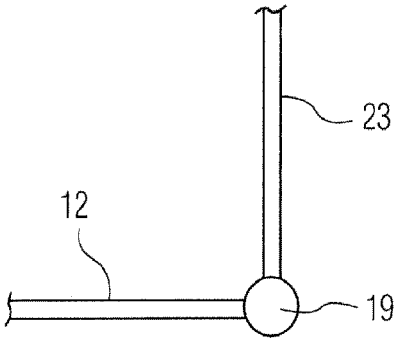
FIG. 8B is a top plans view the first component input conduit and the second component input conduit entering the mixing chamber input conduit at a 90 degree angle.
Figure 8C:
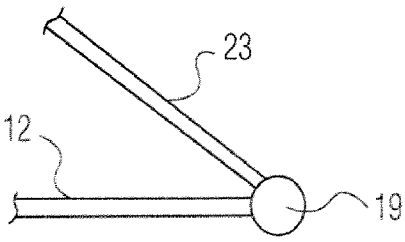
FIG. 8C is a top plan view the first component input conduit and the second component input conduit entering the mixing chamber input conduit at a 45 degree angle.

FIGS. 8A, 8B and 8C illustrate the different angles at which the first component 10 and the second component 20 may be delivered into the mixing chamber input conduit 19. In FIG. 8A, the first component conduit 12 and second component conduit 23 are at a 180 degree orientation, one to the other, at the same point in the mixing chamber input conduit 19, as shown in FIGS. 5 and 6. In FIG. 8B, the first component conduit 12 and second component conduit 23 are at a 90 degree orientation, one to the other at the input to mixing chamber input conduit 19. In FIG. 8C, the first component conduit 12 and second component conduit 21 are at a 45 degree angle orientation, one to the other, at the input to mixing chamber input conduit 19. Essentially, the first component conduit 12 and second component conduit 23 may intersect the mixing chamber input conduit 19 at any angle, as well as each at any point in the mixing chamber 22. In addition there may be a 0 degree orientation by the first component conduit 12 and the second component conduit 23 being, in a coaxial orientation or a side by side orientation. In a coaxial orientation one will be within the other.

FIG. 9 discloses a static mixing element unit 21 which is mounted in mixing chamber 22. This static mixing element unit 21 has a top surface 35 that is 90 degrees to the axis of the static mixing element unit 21 and to the central vertical axis of the static mixer chamber 22. This static mixer 21 has six mixing elements, upper mixing elements 37*a* and 37*b*, middle mixing elements 38*a* and 38*h* and lower mixing elements 39*a* and 39*h*. Each of the six mixing elements 37*a*, 37*b*, 38*a*, 38*b*, 39*a*, 39*b* has a top surface, each top surface is aligned at the same angle relative to the central axis of the static mixer chamber 22. The invention is not so limited, however, and each mixing element may be rotated about the central vertical axis of the static mixer chamber 22. The central vertical axis of the static mixer chamber is labeled as A-A in FIG. 7. In the present process, a wide range of known static mixing element units may be used. This includes those set out in U.S. Pat. No. 3,991,129 (Daniels); U.S. Pat. No. 3,999,592 (Kopp et al.); U.S. Pat. No. 5,053,141 (Laiho); U.S. Pat. No. 4,093,188 (Horner) and U.S. Pat. No. 5,575,409 (Gruenderman). The static mixing element usually will be of an alloy that is inert to the components to be mixed and may be of polymeric materials.

Figure 10:
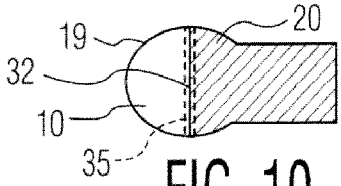
FIG. 10 is a schematic view of the first component and the second component in the mixing chamber input conduit in essentially equal amounts.
Figure 10A:
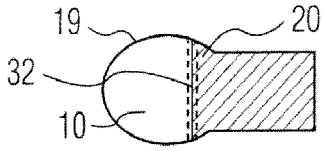
FIG. 10A is a cross-sectional view of the first component and the second component in the mixing chamber input conduit in different amounts.

FIG. 10 illustrates the flow into mixing chamber input conduit 19. This shows the mixing chamber input conduit 19 of FIG. 3 with an equal amount of first component 10 and second component 20 and the interface 32 of first component 10 and the second component 20. FIG. 10A shows this view of FIG. 10 with a content of about 75% first component 10 and 25% second component 20.

Figure 11:
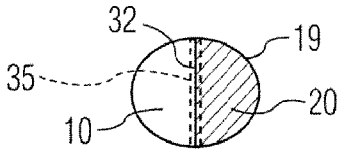
FIG. 11 is a cross-sectional view of the angular contact (0 degree) of the interface of the first component and second component flow in essentially equal amounts into contact with the top surface of the top mixing element of the mixing element unit.
Figure 11A:
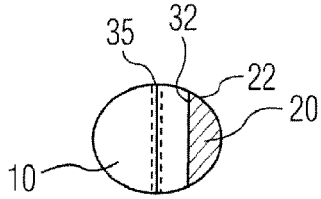
FIG. 11A is a cross-sectional view of the angular contact (0 degree) of the interface of the first component and second component flow in different amounts into contact with the top surface of the top mixing element of the mixing element unit.

FIG. 11 shows the first component 10 and the second component 20 flows of FIG. 3 contacting the top surface 35 of the mixing element unit 21. The first component 10 and second component 20 have a common interface 32. The common interface 32 contacts the top surface 35 of the mixing element unit 21 at a 0 degree angle. FIG. 11A shows the first component 10 and the second component 20 flows of FIG. 11 contacting the top surface 35 of the static mixer 21, where there is a content of about 75% first component 10 and 25% second component 20. The common interface 32 is offset from the top surface 35 of the mixing element unit 21. The common interface 32 and the top surface 35 are parallel with each other and therefore there is a 0 degree angle between the common interface 32 and the top surface 35 upon contact between the first component 10 and the second component 20 with the top surface 35.

Figure 12:
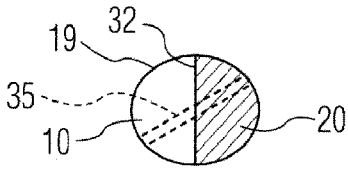
FIG. 12 is a cross-sectional view of the angular contact (45 degrees) of the interface of the first component and second component flow in essentially equal amounts into contact with the top surface of the top mixing element of the mixing element unit.
Figure 12A:
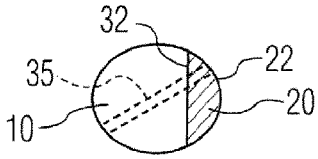
FIG. 12A is a cross-sectional view of the angular contact (45 degrees) of the interface of the first component and second component flow in different amounts into contact with the top surface of the top mixing element of the mixing element unit.

FIG. 12 shows the first component 10 and the second component 20 flows contacting the top surface 35 of the mixing element unit at about a 45 degree contact angle. The common interface 32 contacts the top surface 35 of the mixing element unit 21 at about a 45 degree angle. The interface FIG. 12A shows the first component 10 and the second component flows of FIG. 12 contacting the top surface 35 of the mixing element unit where there is a content of about 75% first component 10 and 25% second component 20. The common interface 32 is offset from the center of the top surface 35 of the mixing element unit 21. The common interface 32 and the top surface 35 intersect with each other at a 45 degree angle. Thus, in FIG. 12A the contact between the common interface 32 and the top surface 35 is at about 45 degrees.

Figure 13:
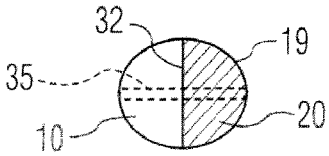
FIG. 13 is a cross-sectional view of the angular contact (90 degrees) of the interface of the first component and second component flow in essentially equal amounts into contact with the top surface of the top mixing element of the mixing element unit.
Figure 13A:
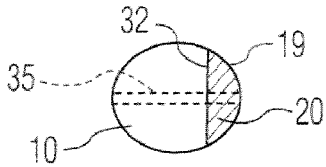
FIG. 13A is a cross-sectional view of the angular contact (90 degrees) of the interface of the first component and second component flow in different amounts into contact with the top surface of the top mixing element of the mixing element unit.

FIG. 13 shows the first component 10 and the second component 20 flows contacting the top surface 35 of the mixing element unit at a 90 degree contact angle. The common interface 32 contacts the top surface 35 of the mixing element unit 21 at about a 45 degree angle. FIG. 13A shows the first component 10 and the second component 20 flows of FIG. 13 contacting the top surface 35 of the mixing element unit where there is a content of about 75% first component 10 and 25% second component 20. The common interface 32 and the top surface 35 intersect with each other at a 90 degree angle. Thus, in FIG. 12A the contact between the common interface 32 and the top surface 35 is at about 90 degrees.

The volume of the first component 10 to the volume of the second component 20, one to the other, can be in a ratio of 20/80 to 80/20. The diffuse design of the product that results will vary depending upon the ratio of the content of the first component 10 to the second component 20. Also the color or the first component 10 and the second component 20 may vary. However, the objective usually will be to use contrasting colors so as to make the diffuse design more vibrant and visible. A useful pairing of two components is to have one white and the other a color. With color matching the variations are essentially unlimited. Further there can be more than two components fed into the mixing chamber. There can be three or more components, and in addition, particles or capsules may be included. This will provide a wider range of diffuse patterns to products.

Figure 15:
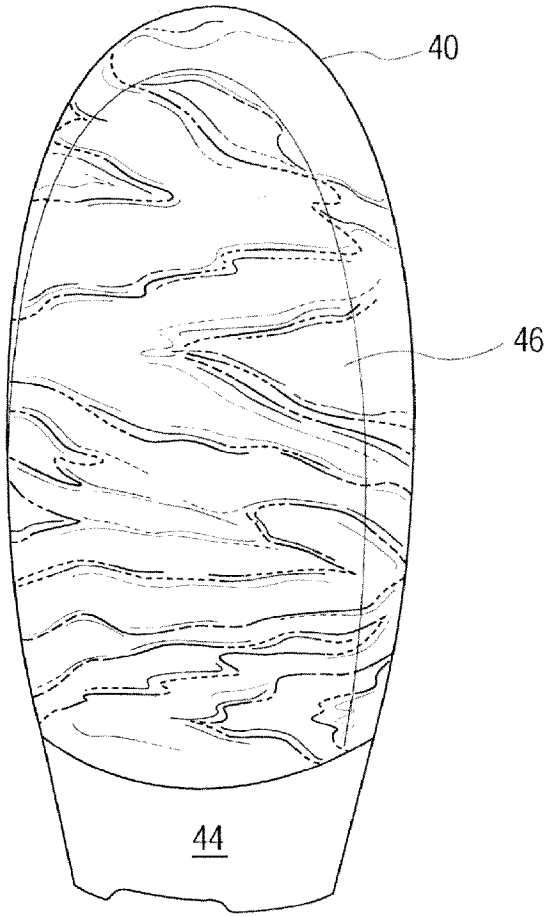
FIG. 15 is a rear elevation view of a container with a diffuse pattern mixture
Figure 14:
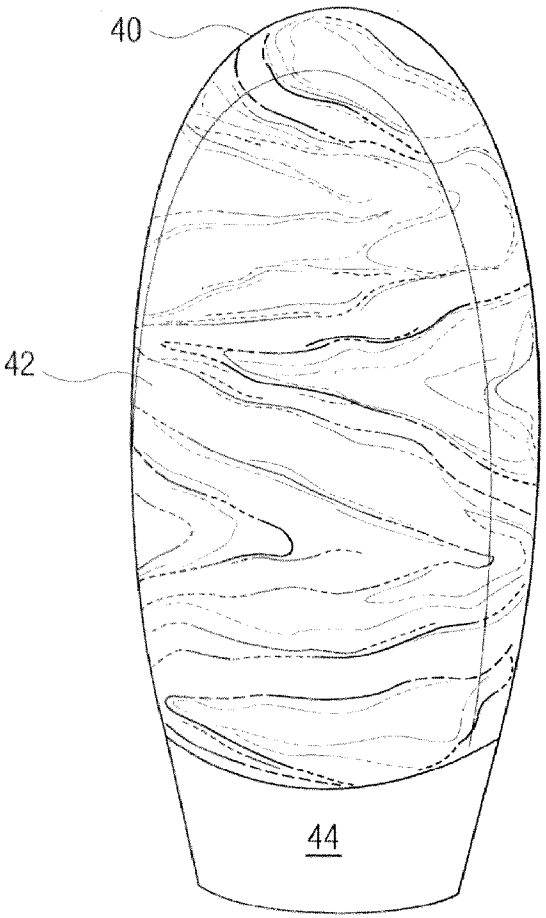
FIG. 14 is a front elevation view of a container with a diffuse pattern mixture

FIG. 14 discloses the front elevation view a container 40 containing a product 30 having a random pattern 42 of components. The container 40 has a closure 44. FIG. 15 discloses the rear elevation view of container 40 with a random pattern 46 to the product 30. It is seen that the design may differ from the front to the rear of the container. Also depicted by the solid lines and the dashed lines is the difference in the texture and the density of the diffuse designs that are produced using the present process.

The container 15 may be of essentially any shape, size or material construction. The only restriction is that the container 15 should be at least partially transparent, thus including container 15 being translucent, since the diffuse design should be at least partially visible through the container surfaces. Since the products will primarily be consumer product-sized, the containers will contain about 250 ml to about 2 liters of product and may be constructed of polyethylene, clarified polypropylene, polyethylene terephthalate and polyvinyl chloride.

The following is an example of a formulation that may be used in the present process to produce diffuse patterns in the final composition. The amounts are in weight percent based on the active weight of the material.

| Ingredient | Weight Percent |
|---|---|
| Deionized water | 50 |
| Tetrasodium EDTA | 0.2 |
| Glycerin | 2.7 |
| Polyethylene glycol 400 | 0.9 |
| Laponite ® XLG layered silica | 0.3 |
| $SO_3Na$ Pareth Sulfate Base (13.4% at 70% active weight) | 9.368 (70% AI) |
| Benzyl alcohol | 0.5 |
| Deionized water | 14.7 |
| Aculyn ® 88 alkali-soluble acrylic | 4.25 |
| Sodium Hydroxide (2.2% at 25% active weight) | 0.59 |
| Kathon ® preservative | 0.08 |
| Cocoamidopropyl Betaine Base (28.8% at 30% active weight) | 8.5 |
| Polyquat 7 acrylamide/diallyldimethyl/ ammonium chloride copolymer | 1.2 |
| Sunflower Oil w/BHT | 0.75 |
| Vitamin E Acetate | 0.02 |
| Ceraphyl ® RMT castor oil maleate | 0.1 |
| Petrolatum | 5 |
| Minors (such as fruit extract, fragrance, pigment) | QS |

1. Combine DI Water, EDTA, Glycerin, PEG-400 and begin to mix; turn on heat
2. After a few minutes of mixing, add Laponite; continue to mix and heat until 55-60° C.
3. AT 55-60° C.; maintain heat and add SPES; mix for 10-15 minutes until homogenous
4. Add Benzyl Alcohol; mix for 5-10 minutes; then add additional water and mix for 5-10 min.
5. Slowly Add Aculyn 88 slowly with constant stirring; turn off heat; mix for 10 minutes
6. Add Sodium hydroxide 25% sol; mix for 10 min.; batch should turn clear pH range 6.2-6.9
7. Add Kathon and mix 5-10 min
8. Add Betaine and mix for 10-15 minutes -continued

| | |
|---|---|
| 9. | Add Polyquat and mix for 10-15 minutes |
| 10. | Add Part 1 of Sunflower Oil (Sunflower Oil mixed with Vit. E); mix for 10 min. |
| 11. | Add Part 2 of Sunflower Oil (Sunflower Oil mixed with Ceraphyl RMT ®); mix for 10 min. |
| 12. | Melt petrolatum until liquefied at about 70° C.; add to batch (batch should not be at temp lower than 40° C.) |
| 13. | Add extract; mix for 5 minutes |
| 14. | Add fragrance; mix for 10 minutes |
| 15 | When batch reaches 25° C.; take viscocity measurement |
| 15 | post add pigment on skid with remaining glycerin in a slurry |

The above formula is used to make both the first component 10 and the second component 20 compositions. The difference is that in the second component 20 pigment is added in the range of 0.07 to 0.1. In this way second component 20 will have a color different from that of first component 10. The amount of pigment added will determine the intensity of the colors in the diffuse patterns. First component 10 and second component 20 will be in a percent weight ratio of about 80/20. However, the invention is not so limited and the ratio may be modified.

In the process to make the product of FIGS. 14 and 15, the process discussed with the apparatus of FIG. 3 was used. The in-line mixer 21 had six mixing elements. The first composition 10 and the second composition 20 were in a ratio by percentage of 80/20. The first component 10 is fed into flow meter input conduit 18 to flow meter 16. From flow meter 16 first component 10 flows to valve 17 through conduit 14. From the valve 17 the first component 10 flows through first component input conduit 12 to mixing chamber input conduit 19. The second component 20 flows through flow meter conduit 28 to flow meter 26. From flow meter 26 the second component flows through conduit 24 to valve 27. From valve 27 the second component flows through second component input conduit 23 to mixing chamber input conduit 19 to join the first component 10. The first component is pumped at a pressure of about 50 psi and the second component is pumped at a pressure of about 30 psi, the pressure will vary depending upon the viscosity of the components 10, 20 and the desired fill rate. Both the first component and the second component flow into and through mixing chamber 22, which contains mixing element unit with three static mixers, and exits into mixing chamber exit conduit 25. The bottle is a 230 ml or 450 ml oval bottle and it is rotated first in a clockwise direction to about 270 degrees and then in a counterclockwise direction to about 270 degrees while raising the mixing chamber exit conduit at 3.4 to 4.6 cm/sec. When the container is full, it is capped and then replaced with an empty container. The above process was repeated two to five times and produced differing diffuse patterns with a sand art appearance.

We claim:

1. A method of forming in a container a diffuse pattern mixture of at least two components, the at least two components having differing visual characteristics, comprising:

(a) providing a filler/mixer having a mixing chamber wherein the mixing chamber comprises:

a mixing chamber input conduit for the at least two components, a first mixing element in the mixing chamber, the first mixing element comprising a top surface and side surfaces tapering downwardly from the top surface, an exit conduit;

(b) providing a container positioned after the mixing chamber on a container support capable of rotating the container;

(c) feeding a first component and a second component into the mixing chamber, wherein the first component and a second component contact the first mixing element to form a first component and second component mixture, the first component and the second component having a common interface, wherein upon contact of the first component and the second component with the first mixing element top surface the common interface is at an angle of 0 degrees to about 90 degrees to the top surface;

(d) concurrently rotating the container in a first direction and feeding the first component and second component mixture from the mixing chamber into the container;

(e) continuing to feed the first component and second component mixture into the container and rotating the container in the first direction and in a second direction; and (f) concurrently separating the container from the mixing chamber during the rotation of the container in a first direction and in a second direction;

wherein the container is rotated at least 90 degrees in the first direction and at least 90 degrees in the second direction.

2. A method as in claim 1 wherein the container is rotated up to about 360 degrees in a first direction and up to about 360 degrees in a second direction.

3. A method as in claim 1, wherein the container is rotated up to about 270 degrees in the first direction and up to about 270 degrees in the second direction.

4. A method as in claim 1 wherein the container support maintains the container at an angle of up to about 15 degrees to a vertical orientation.

5. A method as in claim 1 wherein the container is subject to a vibration during the feeding of the first component and second component mixture to the container.

6. A method as in claim 1 wherein the exit conduit extends into the container at the initiation of the filling of the container and is separated from the container during the filling of the container by one of the exit conduit being withdrawn from the container or the container being withdrawn from the exit conduit.

7. A method as in claim 1 wherein the mixing chamber further comprises a static mixer, the static mixer comprising the first mixing element and from about 2 to about 10 additional mixing elements.

8. A method as in claim 1 wherein the common interface upon contact with the first mixing element top surface is at an angle of about 25 degrees to about 75 degrees to the first mixing element top surface.

9. A method as in claim 1 wherein one of the first component or the second component is fed first into the mixing chamber.

10. A method as in claim 1 wherein the first component and the second component are fed into the mixing chamber at an angle of 0 degrees to about 90 degrees to the axis of the mixing chamber.

11. A method of forming in a container a diffuse pattern mixture of at least two components, the at least two components having differing visual characteristics, comprising:

(a) providing a filler/mixer having a mixing chamber comprising:

a mixing chamber input conduit for the at least two components, a mixing element unit comprising 1 to 10 mixing elements in the mixing chamber, and an exit conduit;

(b) providing a container after the mixing chamber, the container on a container support capable of rotating the container;

(c) feeding a first component and a second component into the mixing chamber and into contact with the mixing element unit to form a first component and a second component mixture;

(d) concurrently rotating the container in a first direction and feeding the first component and second component mixture from the mixing chamber into the container and concurrently separating the container from the mixing chamber during the rotation of the container wherein the mixing element unit comprises an upper mixing element, the upper mixing element having a top surface with side surfaces extending downwardly from the top surface, the first component and the second component having a common interface, wherein upon contact of the first component and the second component with the first mixing element top surface the common interface is at an angle of 0 degrees to about 90 degrees to the top surface.

12. A method as in claim 11 wherein upon contact of the top surface of the upper mixing element with the first component and the second component the common interface is at an angle of about 25 degrees to about 75 degrees to the top surface.

13. A method as in claim 11 wherein the container is rotated at least 90 degrees in a first direction and at least 90 degrees in a second direction.

14. A method as in claim 11 wherein the container is rotated up to about 360 degrees in a first direction and up to about 360 degrees in a second direction.

15. A method as in claim 11 wherein the container support maintains the container at an angle of up to about 15 degrees to a vertical orientation.

16. A method as in claim 11 wherein the container is subject to a vibration during the feeding of the first component and second component mixture to the container.

17. A method as in claim 11 wherein the exit conduit extends into the container at the initiation of the filling of the container and is separated from the container during the filling of the container by one of the exit conduit being withdrawn from the container or the container being withdrawn from the exit conduit.

18. A method as in claim 11 wherein the mixing unit is a static mixer having from about 1 to about 5 mixing elements.

* * * * *